US010264839B2

(12) United States Patent
Blackwell

(10) Patent No.: US 10,264,839 B2
(45) Date of Patent: Apr. 23, 2019

(54) HEADWEAR

(71) Applicant: Emmanuel J. Blackwell, Buford, GA (US)

(72) Inventor: Emmanuel J. Blackwell, Buford, GA (US)

( * ) Notice: Subject to any disclaimer, the term of this patent is extended or adjusted under 35 U.S.C. 154(b) by 0 days.

(21) Appl. No.: 15/016,252

(22) Filed: Feb. 4, 2016

(65) Prior Publication Data

US 2016/0360815 A1 Dec. 15, 2016

Related U.S. Application Data

(60) Provisional application No. 62/087,599, filed on Dec. 4, 2014.

(51) Int. Cl.

| | |
|---|---|
| ***A42B 1/00*** | (2006.01) |
| ***A42B 1/24*** | (2006.01) |
| ***A42B 1/04*** | (2006.01) |

(52) U.S. Cl.

CPC ..... *A42B 1/241* (2013.01); *A42B 1/048* (2013.01)

(58) Field of Classification Search

CPC ..... A41D 23/00; A42B 1/241; A42B 1/048
See application file for complete search history.

(56) References Cited

U.S. PATENT DOCUMENTS

| | | | | |
|---|---|---|---|---|
| 958,329 | A * | 5/1910 | Siegel | A42B 1/041 2/207 |
| 1,316,778 | A * | 9/1919 | Ensten | A42B 1/045 2/172 |
| 9,326,559 | B2 * | 5/2016 | Roban | A42B 1/048 |
| 2005/0039242 | A1 * | 2/2005 | Edmondson | A41D 23/00 2/207 |
| 2011/0004971 | A1 * | 1/2011 | Benderradji | A41D 23/00 2/84 |
| 2011/0131704 | A1 * | 6/2011 | Hughes | A42B 1/048 2/204 |
| 2015/0113699 | A1 * | 4/2015 | Geronimo | A42B 1/048 2/84 |
| 2017/0135422 | A1 * | 5/2017 | Guilfoyle | A41D 15/005 |

* cited by examiner

*Primary Examiner* — Khaled Annis
(74) *Attorney, Agent, or Firm* — Steven C. Stewart

(57) ABSTRACT

Implementations of a headwear are provided. In some implementations, a headwear comprising a hood portion, a right shoulder portion, a left shoulder portion, a right handle, a left handle, and a back portion. In some implementations, the right handle and left handle are elongated pieces of material that extend from the front portion of the right shoulder portion and left should portion, respectively, downwardly toward a wearer's waist when the hood portion is placed on the wearer's head. In some implementations, the back portion of the headwear extends from the back portion of the hood portion, right shoulder portion, and left shoulder portion downwardly toward a wearer's waist when the hood portion is placed on the wearer's head.

14 Claims, 3 Drawing Sheets

HEADWEAR

CROSS REFERENCE TO RELATED APPLICATION

This application claims the benefit of U.S. patent application Ser. No. 62/087,599, which was filed on Dec. 4, 2014, and is incorporated herein by reference in its entirety.

TECHNICAL FIELD

This disclosure relates to implementations of a headwear.

BACKGROUND

Players of sports, for example, often use towels after sporting events to drape over their heads. The towels have no shape and not designed to be worn over the over a user's head U.S. Pat. No. 6,678,896 discloses a sports towel, however, the sports towel has no defined shape similar to ordinary towels.

DETAILED DESCRIPTION

Implementations of a headwear are provided. In some implementations, a headwear comprising a hood portion, a right shoulder portion, a left shoulder portion, a right handle, a left handle, and a back portion. In some implementations, the right handle and left handle are elongated pieces of material that extend from the front portion of the right shoulder portion and left should portion, respectively, downwardly toward a wearer's waist when the hood portion is placed on the wearer's head. In some implementations, the back portion of the headwear extends from the back portion of the hood portion, right shoulder portion, and left shoulder portion downwardly toward a wearer's waist when the hood portion is placed on the wearer's head.

Figure 1A:
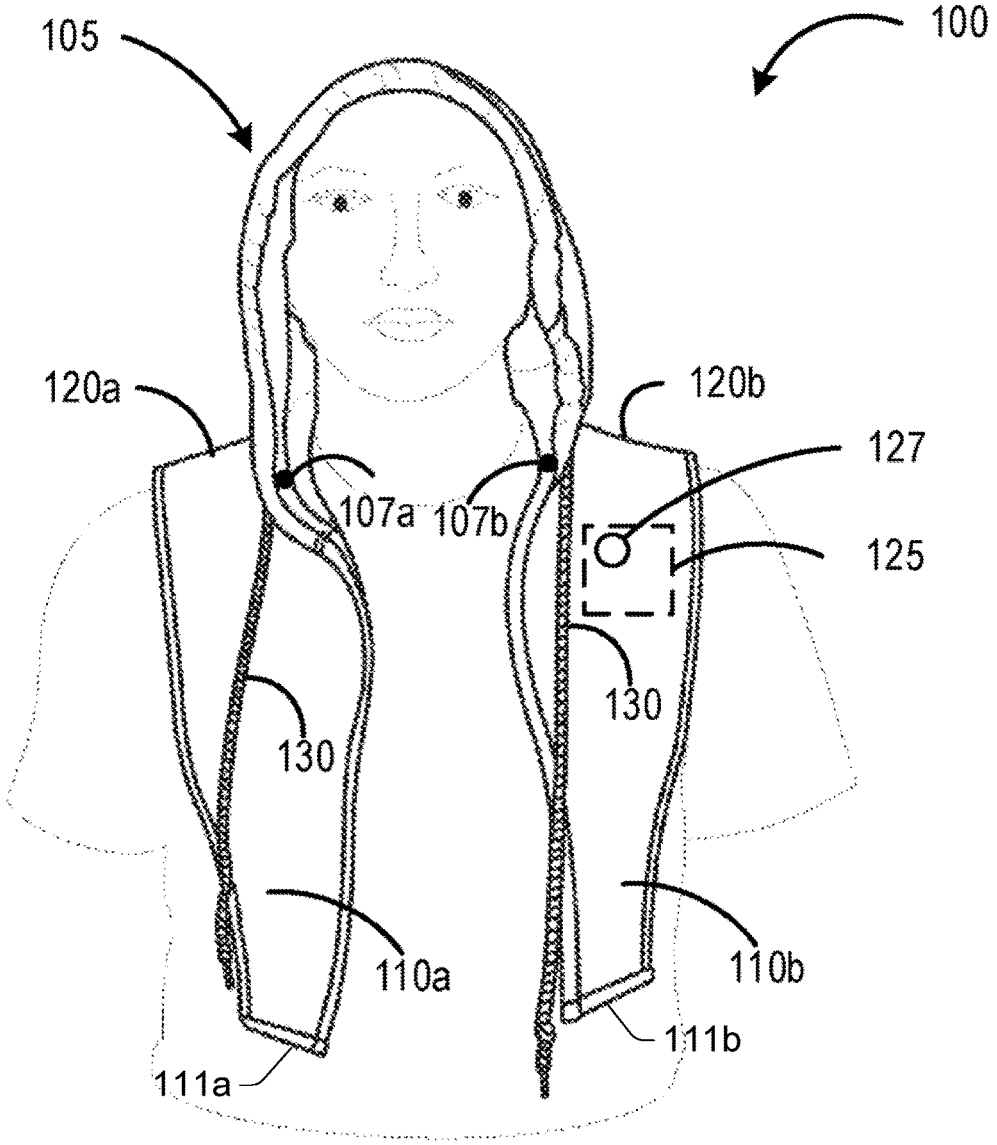
FIGS. 1A-1C illustrate an example implementation of a headwear according to the present disclosure.
Figure 1B:
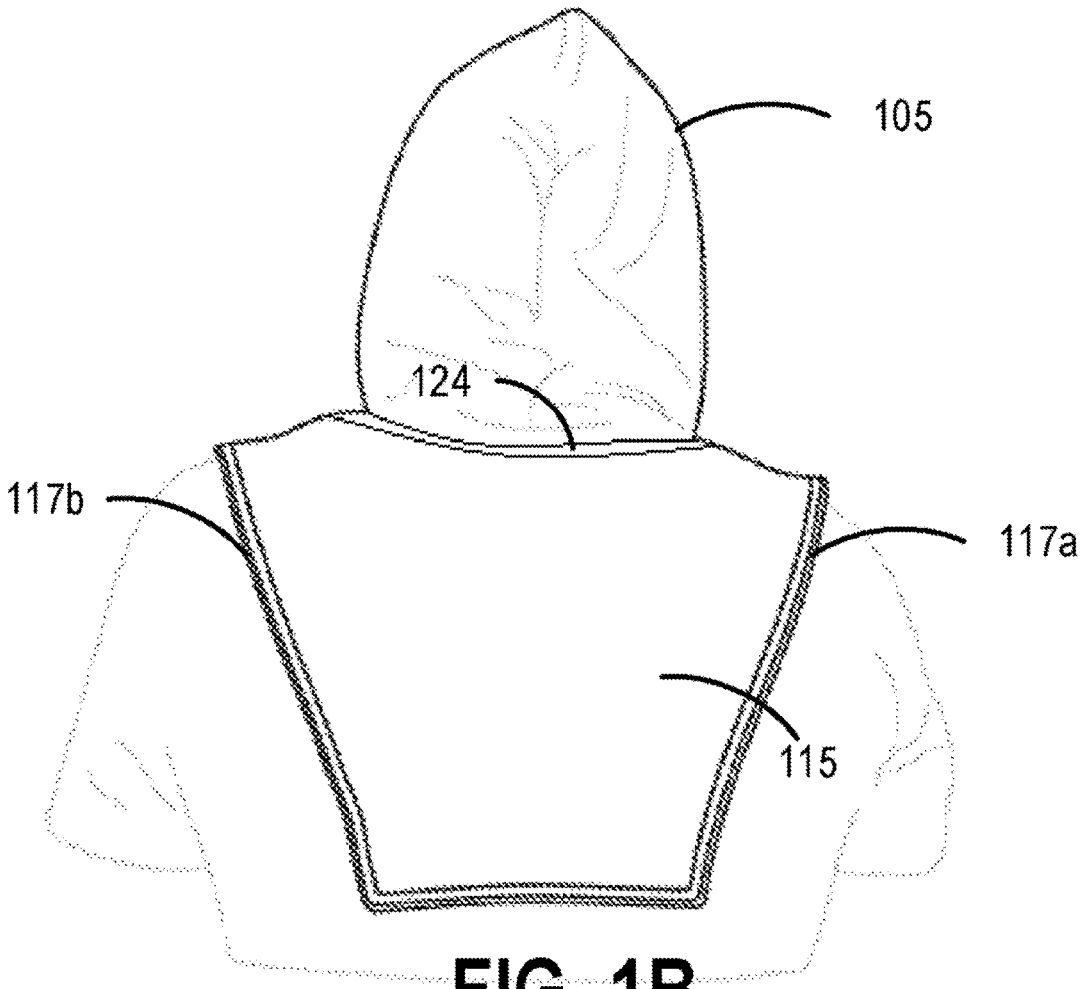
Figure 1C:
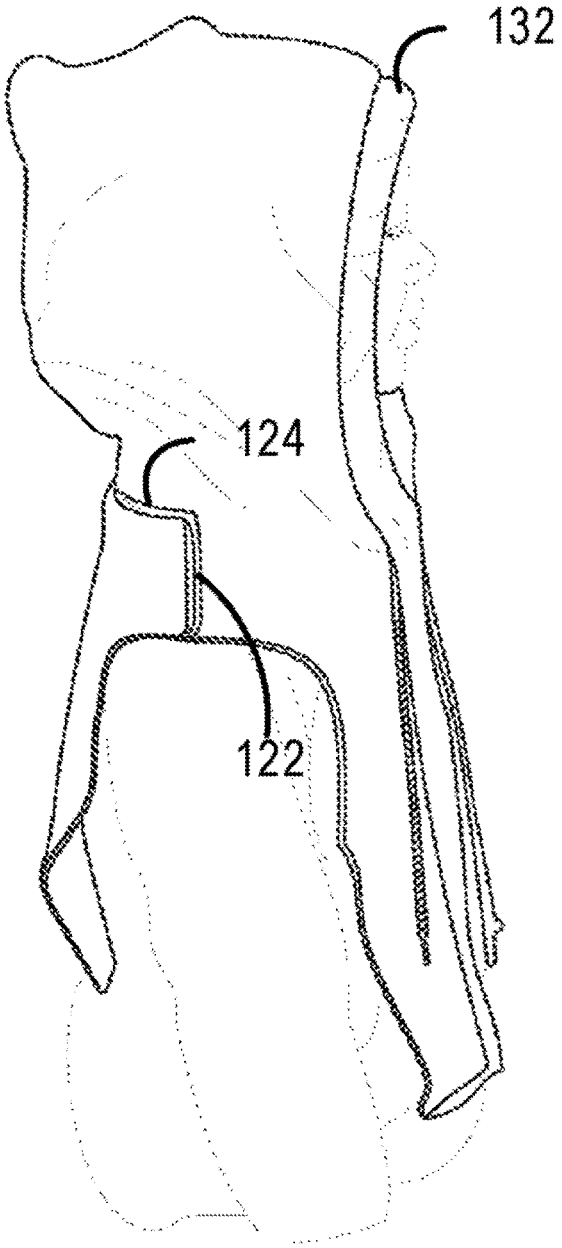

FIGS. 1A-1C illustrate an example implementation of a headwear device 100 according to the present disclosure.

As shown in FIGS. 1A and 1B, in some implementations, the headwear device 100 may be comprised of a hood 105, a pair of handles, left handle 110*a*, right handle 110*b* (collectively 110), and a back segment 115. The left handle 110*a* terminate at a distal end (opposite from a left shoulder portion) at a left edge 110*a*, and right handle 110*b* terminates at a distal end (opposite from a right shoulder portion) at a right edge 111*b*. As shown in FIGS. 1A-1C, in some implementations, the pair of handles 110 and the back segment 115 may extend from shoulder portions 120*a*, 120*b* (collectively 120) of the headwear device 100.

As shown in FIG. 1A, in some implementations, the hood 105 of the headwear device 100 may be configured to cover the wearer's head or a portion thereof. In some implementations, the hood 105 may cover all but the face portion of a wearer's head.

As shown in FIG. 1A, in some implementations, the hood 105 may include a drawstring 130 for tightening the hood 105 about the head of a wearer. In some implementations, the hood 105 may include two or more drawstrings for tightening the hood 105. As shown in FIG. 1C, in some implementations, the drawstring 130 may extend through a channel 132 positioned about the opening of the hood 105.

Methods of creating a channel 132 for the drawstring 130 are known to one of ordinary skill in the art.

As shown in FIG. 1A, in some implementations, the hood 105 may include a fastener 107 having a first portion 107*a* and a second portion 107*b* to bring the two sides of the hood 105 together. This may help, among other things, to secure the headwear device 100 onto the wearer's head.

In some implementations, the fastener 107 may be used to secure the headwear device 100 in place about the wearer's shoulder when the hood 105 is pulled back from the wearer's head. In some implementations, the fastener 107 may be positioned on the hood 105 so that it is at the approximate neck level of the wearer. In some implementations, the fastener 107 may be positioned at any suitable location on the hood 105 or handles 110 of the headwear device 100. In some implementations, the fastener 107 may be a combination of hook and loop fasteners (e.g., Velcro®). In some implementations, the fastener 107 may be a zipper. In some implementations, the fastener 107 may be any fastening means such as snaps, buttons, magnets or other reclosable fasteners or any other attachment or fastening technology existing or developed in the future.

As shown in FIG. 1A, in some implementations, the handles 110*a*, 110*b* of the headwear device 100 may be positioned on each side of the hood 105. In some implementation, the handles 110 are elongated pieces of material that may extend from the shoulder area downwardly towards the waistline. In some implementations, the handles include an inner side and an, opposite outer side where the inner side faces the user and the outer side faces outwardly. In some implementations, the handles are flat. In some implementations, the inner side faces one direction and outer side faces one direction. In some implementations, the handles are not flat.

In some implementations, the handles 110 may have a generally rectangular shape. In some implementations, the handles 110 may have an irregular but generally elongated shape or lance shape. In some implementations, the length of the handles 110 is greater than the width of the handles 110.

As shown in FIG. 1C, in some implementations, each handle 110*a*, 110*b* extends from both the hood 105 and a shoulder portion 120*a*, 120*b*, respectively, of the headwear device 100.

In some implementations, each handle 110*a*, 110*b* extends from a seam 122 present on the shoulder portions 120*a*, 120*b*, respectively, of the headwear device 100 (see, e.g., FIG. 1C).

As shown in FIG. 1A, in some implementation, the handle 110*a* and 110*b* are configured to extend past the chest area of a wearer to cover a portion of the wearer's chest while terminating at edge 111*a* and 111*b* respectively above a waist of the wearer. In one embodiment handles 110 when cover a portion of the wearer's chest allow complete exposure of the wearer's arms. In some implementations, the handles 110 may be positioned and configured (e.g., length and/or width of the handles 110) to be grasped by a user wearing the headwear device 100. In some implementations, the length of the handles are at least as long as hood 105. In some implementations, the length of the handles from the seam to the distal end are at least as long as hood 105 from the top of the hood to the bottom of the hood when the hood is on a wearer's head.

In some implementations, the handles 110 are the same or approximately the same length (see, e.g., FIG. 1A). In some implementations, the handles 110 are of sufficient length so as to allow a user to wipe their forehead with an end portion thereof. To this end, in some implementations, a portion of the handles 110 may be made of a microfiber material or any absorbent material.

As shown in FIG. 1A, in some implementations, one or both of the handles 110*a*, 110*b* may include a pocket 125 thereon. In some implementations, the pocket 125 may be positioned on an interior side and/or exterior side of either handle 110*a*, 110*b*. In some implementations, the pocket 125 may be configured to receive an MP3 player or similar device or other portable electronic device.

In some implementations, the pocket 125, handle, or any other portion of the headwear may include an opening (e.g., opening 127) extending therethrough thereby allowing a wire for headphones, ear buds, or similar devices to extend therethrough. In some implementations, the pocket 125 may not include an opening.

As shown in FIG. 1B, in some implementations, the back segment 115 is configured to cover a portion of a wearer's back. In some implementation, the back segment 115 may extend from the shoulder area downwardly towards the waistline. In some implementations, the back segment 115 may extend from both the hood 105 and shoulder portions 120 of the headwear device 100 (see, e.g., FIGS. 1B and 1C).

In some implementations, the back segment 115 may extend from a seam 122 present on both shoulder portions 120 of the headwear device (see, e.g., FIG. 1C). As shown in FIG. 1A, in some implementation, the back segment 115 is configured to extend past the shoulder blade of a wearer to cover a portion of the wearer's back.

As shown in FIG. 1B, in some implementations, the back segment 115 may be wider at its top than at its bottom. In some implementations, the sides 117*a*, 117*b* (collectively 117) of the back segment 115 may be tapered along their length (see, e.g., FIG. 1B).

As shown in FIG. 1C, in some implementations, the back segment 115 may be shorter in length than the handles 110. In some implementations, the back segment 115 may be longer in length than the handles 110. In some implementations, the back segment 115 may be the same length as the handles 110.

In some implementations, the weight of the back segment 115 may act against the weight of the handles 110 thereby balancing the headwear device 100 when in use. In this way, the handles 110 may be prevented from pulling the headwear device 100 forward and thereby dislodging it from the wearer's head.

In some implementations, when the hood portion 105 is resting on the shoulders of the wearer and/or back, the back segment 115 in conjunction with the hood portion 105 may act against the weight of the handles 110 thereby balancing the headwear device 100 when in use.

In some implementations, the headwear device 100 or portion thereof may be manufactured from a microfiber material (e.g., polyester, polyamides, polypropylene, or a conjugation thereof, microfiber material). In some implementations, the headwear device 100 or portion thereof may be manufactured from a split microfiber material. In some implementations, the headwear device 100 or portion thereof may be manufactured from any absorbent synthetic, semi-synthetic, or natural fiber, or combination thereof, material.

As shown in FIGS. 1B and 1C, in some implementations, the head portion 105, the handle portions 110, and the back segment 115 may be separate pieces joined together at seams 122, 124. In some implementations, the separate pieces may be manufactured from one or more different materials.

In some implementations, the headwear device 100 or portion thereof may be manufactured from a single piece of material.

In some implementations, the headwear device 100 or portion thereof may be manufactured from a single layer of material. In some implementations, the headwear device 100 or portion thereof may be manufactured from multiple layers of material. For example, in some implementations, an end portion of each handle 110*a*, 110*b* may have one or more additional layers of material thereon to better facilitate the absorption of sweat when used to wipe off the forehead or other portions of the face. As another example, in some implementations, the entire length of each handles 110 interior side may have one or more additional layers of material thereon to better facilitate the absorption of sweat when used to wipe off the forehead or other portions of the face. As yet another example, in some implementations, the underside of the back segment 115 may include one or more additional layers of material thereon to better facilitate the absorption of sweat.

In some implementations, the head portion 105, the handle portions 110, and the back segment 115 may be separate pieces joined together by any method currently known or developed in the future by one of ordinary skill in the art having the benefit of the present disclosure.

In some implementations, the headwear device 100 may be fashionable for daily wear. In some implementations, the headwear device 100 may be used during a pre-exercise warmup or post exercise cool down. In some implementations, the headwear device 100 may be worn at any time a wearer finds it desirable.

In some implementations, the back segment 115, the handle portions 110, and the hood portion 105 may be used as advertisement space and/or to place a message, name, logo, or any other indicia.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An article of manufacture comprising:

one of more pieces of material configured to form a headwear comprising a hood portion, a right shoulder portion, a left shoulder portion, a right handle, a left handle, and a back portion, wherein:

the hood portion comprising material configured to form an opening on an inner side of the headwear, the hood portion material comprising a front portion, a left portion, a right portion, a middle portion, and a back portion such that when the head covering is placed on a wearer's head, the front portion is an anterior portion, the left portion is a left lateral portion, the right portion is a right lateral portion, the middle portion is a superior portion, and the back portion is a posterior and an inferior portion, the right shoulder portion extending from the right portion of the hood portion and comprises material configured to cover a portion of the wearer's right shoulder while exposing another portion of the wearer's right shoulder when the hood portion is placed on the wearer's head, the right shoulder material comprising a front portion and a back portion;

the left shoulder portion extending from the left portion of the hood portion and comprises material configured to cover a portion of a wearer's left shoulder while exposing another portion of the wearer's left shoulder when the hood portion is placed on the wearer's head, the left shoulder material comprising a front portion, and a back portion;

the right handle including a right elongated piece of material having one end coupled with the right shoulder portion and having a right edge formed at another end opposite from the right should portion, the right elongated piece of material extending from the front portion of the right shoulder portion with the right edge terminating above a wearer's waist while covering a portion of the wearer's chest and completely exposing a wearer's right arm and right leg;

the left handle including a left elongated piece of material having one end coupled with the left shoulder portion and having a left edge formed at another end opposite from the left should portion, the left elongated piece of material extending from the front portion of the left shoulder portion with the left edge terminating above the wearer's waist while the handle covers a portion of the wearer's chest and completely exposes a wearer's left arm;

the back portion of the headwear extending from the back portion of the hood portion, the back portion of the right shoulder portion, and the back portion of the left shoulder portion toward the wearer's waist to cover a portion of a wearer's back while completely exposing the wearer's left and right arm when a) the right shoulder portion rests on the wearer's right shoulder and the right handle extends from the front portion of the right shoulder portion and terminates at the right edge above the wearer's waist while the right handle covers a portion of the wearer's chest, and b) the left shoulder portion rests on the wearer's left shoulder and the left handle extends from the front portion of the left shoulder portion and terminates at the left edge above a wearer's waist while the left handle covers a portion of the wearer's chest; and wherein at least one of the right handle and the left handle includes a pocket on an upper portion adjacent the hood portion, the pocket forming an opening to allow a wire to extend therethrough or to receive a portable electronic device.

2. The article of manufacture of claim 1 further comprising a fastener configured to join a right portion of the headwear with a left portion of the headwear.

3. The article of manufacture of claim 2 wherein the fastener engages with the right portion and the left portion of the hood.

4. The article of manufacture of claim 2 wherein the fastener engages with the right handle and left handle.

5. The article of manufacture of claim 1 wherein the right handle and left handle have a generally rectangular shape.

6. The article of manufacture of claim 1 wherein the back portion of the hood portion is tapered such that the back portion of the headwear becomes narrower as it extends from the back portion of the hood portion, the back portion of the right shoulder portion, and the back portion of the left shoulder portion extend toward the waist of the wearer and terminates in an edge above the waist when the right shoulder portion rests on the wearer's right shoulder and the left shoulder portion rests on the wearer's left shoulder.

7. The article of manufacture of claim 1 wherein back portion of the hood has a length that is shorter than the right and left handles, and wherein the right and left handles respectively from a lance shape that extend over the chest of the wearer with the left and right edge completely terminating above the waist of the wearer when the right shoulder portion rests on the wearer's right shoulder and the left shoulder portion rests on the wearer's left shoulder.

8. The article of manufacture of claim 1 wherein back portion of the hood is configured to extend past a shoulder blade area of the wearer when the right shoulder portion rests on the wearer's right shoulder and the left shoulder portion rests on the wearer's left shoulder.

9. Headwear comprising:

material forming a hood portion, a right handle, a left handle and a back portion;

the hood portion having a back hood portion, a right side portion and a left side portion in combination operative to cover the head of a wearer but expose the face of the wearer;

the back portion connected to the hood portion and operative to cover a portion of a back of the wearer when the hood rests on a head of the wearer;

the right and left handles including elongated pieces of material respectively that connect at one end above a shoulder of the wearer to the back portion and the hood portion when the hood rests on a head of the wearer; and the right and left handles to extend away from the back portion over a chest of the wearer and respectively include a right edge and a left edge to terminate an extension of the right and left handle above a waist of the wearer when the hood rests on the head of the wearer and the left handle and right handle cover a portion of the wearer's chest, the right handle when covering a portion of the wearer's chest forming a partial opening with the back portion to permit viewing of the right arm of the wearer, and the left handle when covering a portion of the wearer's chest forming a partial opening with the back portion to permit viewing of the left arm of the wearer; and wherein at least one of the right handle and the left handle includes a pocket on an upper portion adjacent the hood portion with an opening to allow a wire to extend therethrough or to receive a portable electronic device.

10. The headwear of claim 9 wherein the hood portion is tapered such the back portion becomes narrower as it extends from the back portion of the right shoulder portion and the back portion of the left shoulder portion toward the waist of the wearer when the back portion covers a portion of the wearer's back, and a) the right shoulder portion rests on the wearer's right shoulder and b) the left shoulder portion rests on the wearer's left shoulder.

11. The headwear of claim 9 wherein when the right shoulder portion rests on the wearer's right shoulder and the left shoulder portion rests on the wearer's left shoulder:

the back portion extends and terminates at an edge a shorter distance away from the shoulders of the wearer than the right handle's right edge and left handles left edge terminate, and wherein the extension of the right handles right edge to completely terminate above and adjacent to the waist of the wearer when the right handle extends over the wearers chest and wherein extension of the left handles right edge to completely terminate above and adjacent to the waist of the wearer when the left handle extends over the wearers chest.

12. The headwear of claim 9 wherein the hood comprises a channel to receive a drawstring, and the drawstring fed through the channel and operative to reduce exposure of the wearer's face and seal the hood around the neck of wearer when the hood rests on a head of the wearer.

13. The headwear of claim 12 further comprising a magnetic fastener operative to engage with the right portion and the left portion of the handle to connect a portion of the left handle with a portion of the right handle adjacent to a neck of the wearer when the hood rests on a head of the wearer.

14. The headwear of claim 9 wherein the left and right handle are lance shaped with the edge at a distal end.

* * * * *